US005292567A

United States Patent [19]

Foster

[11] Patent Number: 5,292,567

[45] Date of Patent: Mar. 8, 1994

[54] BUFFING PAD

[75] Inventor: James Foster, Numeaton, England

[73] Assignee: Minnesota Mining and Manufacturing Company, St. Paul, Minn.

[21] Appl. No.: 911,343

[22] Filed: Jul. 8, 1992

Related U.S. Application Data

[63] Continuation of Ser. No. 701,875, May 17, 1991, abandoned.

[51] Int. Cl.[5] ..... B32B 5/06; B32B 5/22

[52] U.S. Cl. ..... 428/64; 428/100; 428/213; 428/299; 428/300; 428/303; 428/332; 428/340; 15/104.8; 15/208

[58] Field of Search ..... 428/100, 224, 245, 303, 428/332, 340, 64, 213, 299; 15/104.8, 208

[56] References Cited

U.S. PATENT DOCUMENTS

| | | | |
|---|---|---|---|
| 2,854,286 | 9/1958 | Salick | 428/64 |
| 3,112,584 | 12/1963 | Cameron | 51/185 |
| 3,703,739 | 11/1972 | Young et al. | 428/65 |
| 3,817,015 | 6/1974 | Frangos | 428/100 |
| 4,149,294 | 4/1979 | MacKay, Jr. et al. | 428/95 |
| 4,244,074 | 1/1981 | Barcikowski et al. | 15/114 |
| 4,692,958 | 9/1987 | McMakin | 15/230.12 |
| 4,758,290 | 7/1988 | McMakin | 428/86 |
| 4,761,318 | 8/1988 | Ott et al. | 428/100 |
| 4,829,719 | 5/1989 | Braselton | 51/180 |
| 4,842,916 | 6/1989 | Ogawa et al. | 428/100 |
| 4,907,313 | 3/1990 | Roeker et al. | 15/98 |
| 5,001,804 | 3/1991 | Roeker et al. | 428/95 |
| 5,030,496 | 7/1991 | McGurran | 428/85 |

FOREIGN PATENT DOCUMENTS

| | | |
|---|---|---|
| 0333611 | 9/1989 | European Pat. Off. . |
| 3903204 | 2/1990 | Fed. Rep. of Germany . |
| 1083547 | 9/1967 | United Kingdom . |

*Primary Examiner*—George F. Lesmes
*Assistant Examiner*—Terrel Morris
*Attorney, Agent, or Firm*—Gary L. Griswold; Walter N. Kirn; Gregory D. Allen

[57] ABSTRACT

A buffing pad adapted to be releasably engaged with a buffing apparatus having a hookface type attachment surface and a method of making the same are taught.

14 Claims, No Drawings

BUFFING PAD

This is a continuation of application Ser. No. 07/701,875 filed May 17, 1991 now abandoned.

FIELD OF THE INVENTION

The present invention relates to buffing pads and in particular to buffing pads adapted to be releasably engaged with buffing apparatus having an attachment surface of the hook-face type.

BACKGROUND OF THE INVENTION

One construction of buffing pad commonly used in the automobile trade comprises a web of non-woven fibers. The attachment surface of the back-up pad of buffing apparatus, such as rotary and orbital buffers, is provided with a multiplicity of projecting, resiliently-flexible filaments bearing at the distal end thereof a bulbous substantially semi-spherical head or hook. This surface is commonly referred to as a hook-face attachment surface. When the buffing pad is placed against the attachment surface the head or hooks of the attachment surface mechanically interlock with the non-woven fibers of the pad to secure the pad in position. As such, this type of buffing pad has found great favor by allowing the user to easily reposition the pad or remove it entirely for replacement.

It has been found that commercially available buffing pads manufactured from thick fibers having a caliper of about 17 dtex while providing good adhesion to the back-up pad and good buffing properties for use on original automotive equipment manufacture painted surfaces tend to be too aggressive when used on other paint surfaces, e.g., the softer after-market air-dried or low-bake paints normally used in body repair shops. Buffing pads formed from finer fibers, e.g., having a dtex of 6.7, while proving acceptable for use with softer paint finishes are found to have a poor adhesion for the hook-face attachment surfaces of the back-up pad and are often displaced during use.

SUMMARY OF THE INVENTION

The present invention provides a buffing pad suitable for use with softer paint products but having an improved adhesion for buffing apparatus having a hook-face attachment surface.

According to the present invention there is provided a buffing pad adapted to be releasably engaged with a buffing apparatus having an attachment surface of the hook face type, the buffing pad comprising a non-woven buffing layer comprising crimped fibers having a fiber thickness of up to 11 dtex and a fiber length of at least 40 mm, and a nonwoven attachment layer comprising crimped fibers having a fiber thickness greater than 11 dtex and a fiber length of at least 40 mm.

The buffing pads of the invention comprise a multilaminate construction formed from the combination of thick and thin fibers, with a preponderance of thick fibers forming an attachment layer to provide good adhesion to the attachment surface of the back-up pad, and a preponderance of thin fibers forming a buffing layer to provide a milder buffing action suitable for use with softer substrates.

DETAILED DESCRIPTION OF PREFERRED EMBODIMENTS

The total thickness of the buffing pad varies with its intended use, but generally the pads are formed with a thickness in the range from 3 to 8 mm, preferably in the range from 4 to 6 mm, with a typical value being about 5 mm. Although buffing pads may be constructed outside of this range, pads less than 3 mm thick tend to lack sufficient structural integrity for prolonged use and for pads greater than 8 mm thick there is no further practical advantage to be gained without the cost of manufacture becoming uneconomical.

The buffing pads comprise a laminate of a buffing layer bonded to an attachment layer optionally via one or more intermediate layers. The non-woven, crimped fibers of the attachment layer provide a surface having a multiplicity of loops suitable for engagement with the filament of a hook-face attachment surface. The buffing layer generally comprises at least 50% of the total pad thickness, normally in the range from 50 to 75% with the remainder comprising the attachment layer. Preferably, the buffing layer comprises in the range from 50 to 65% of the total pad thickness and the attachment layer in the range from 50 to 35%.

The buffing pads generally have a density in the range from 0.1 to 0.3 g/cm$^3$, preferably in the range from 0.12 to 0.18 g/cm$^3$, with a typical value in the range from about 0.15 to 0.16 g/cm$^3$. The buffing pads typically are in a form of circular discs having diameters in the range from 50 to 200 mm.

The buffing/layer is composed of thin fibers having a caliper of up to 11 dtex, preferably up to 8 dtex, with a typical value being about 6.7 dtex. The length of the individual fibers is normally at least 40 mm to reduce linting during use, i.e., detachment of individual fibers. Generally, the length of the buffing layer fibers is in the range from 40 to 200 mm, preferably in the range from 40 to 80 mm, with a typical value of about 60 mm. Fibers of greater than 200 mm length may be used but tend to present handling difficulties during manufacture.

The attachment layer comprises thicker fibers having a caliper of greater than 11 dtex, preferably at least 13 dtex, with a typical value of about 17 dtex. The attachment layer may comprise solely "thick" fibers or a blend of both thick and thin fibers may be used. The fibers of the attachment layer generally have a length in the range from 40 to 200 mm, preferably in the range from 60 to 100 mm, with a typical value being about 75 mm.

Suitable crimped fibers are known in the art and are commercially available in a range of standard dtex, such as, for example, 1.5, 3.3, 6.7, 8.9, 11, 13, 17, 23 and 30. The fibers may be formed from natural materials, such as, for example, wool, cotton and other cellulosic materials, and synthetic polymers and co-polymers such as, for example, polyamides, polyacrylates, polyesters, nylons and viscose. Each layer may comprise a single fiber type or a mixture of two or more fibers.

It is preferred to fabricate the buffing layer from fibers of a different color or tonal contrast to those used in the attachment layer as this is found to provide a simple and effective means of indicating to the user, the correct orientation of the buffing pad. This may be conveniently achieved by employing some colored fibers in the attachment layer, e.g., 30% colored fibers and 70% white fibers.

The buffing and attachment layers may be secured to each other by any desirable means, but are preferably secured by interlocking fibers from the two layers, e.g., by needle punching the laminate. In order to avoid fibers from the attachment layer extending through the surface of the buffing layer, which would impart an aggressive nature to the buffing surface, the needle punching is preferably effected from the buffing layer causing fibers from the buffing layer to be intermingled with the fibers in the attachment layer. Needle punching is a conventional technique in the manufacture of certain types of non-woven materials. Generally, needle punching of the laminate is effected using needle size numbers in the range from 38 to 32. Typically the needle punching maybe effected to provide approximately 500 apertures/$cm^2$.

The individual buffing and attachment layers may be formed from the filaments by a similar needle punching process. Generally, the fibers are carded, air laid as a web, compressed by calender rollers and needle punched to form a self-supporting material. The buffing layer and/or the attachment layer may be formed by combining two or more of such webs of material and needle punching.

The composite comprising the buffing and attachment layers may undergo a further treatment in which a bonding agent is applied throughout the composite to provide further structural integrity and to reduce the propensity of the material to lint during use. The bonding agent is conveniently applied by immersion the material in a bath of liquid bonding agent followed by drying, e.g., in a air tunnel or with infrared heaters. Suitable commercially available bonding agents include, for example, polyvinyl alcohol, polyvinyl acetate, acrylic emulsions, butadieneacrylo nitrile copolymer and other water-dispersible lattices. The bonding agents are usually employed as a 15 to 25%, typically 20% by weight of solids dispersed in water.

The buffing pads of the invention are suitable for use in any type of buffing apparatus having a hook-face attachment surface. The buffing apparatus may be of the rotary or orbital type or it may be in the form of a block or pad for hand use. The hook-face attachment surface comprises a multiplicity of projecting, resiliently-flexible filaments having at the distal end thereof a head or hook-like projection. Suitable hookface attachment surfaces generally comprise in the range from 50 to 120 filaments/$cm^2$, preferably in the range from 60 to 100 filaments/$cm^2$, the filaments having an average height in the range from 0.75 to 1.5 mm, preferably in the range from 0.9 to 1.3 mm; an average diameter in the range from 0.15 to 0.35 mm, preferably in the range from 0.2 to 0.3 mm; and an average head diameter in the range from 0.4 to 0.75 mm, preferably in the range from 0.55 to 0.65 mm.

Suitable materials are commercially available under the trademarks "1H2" from Kanebo Bell-Touch Ltd. of Osaka, Japan, "HOOK-IT" from Minnesota Mining and Manufacturing Company of St. Paul, Minn. and "KLETTOGRIP" from Gottlieb Binder GmbH and Co. of Holzgerlingen, Germany. Typical rotary buffer apparatus will utilize a circular buffing pad having a diameter in the range from 50 to 200 mm.

A typical process for the manufacture of a buffing pad in accordance with the invention comprises:

providing a source of crimped fibers suitable for the buffing layer, e.g., having a caliper of 6.7 dtex and an average fiber length of 60 mm, e.g., in the form of a bale;

carding the fibers and air laying the carded fibers in one or more layers onto a moveable support member to form a fleece of substantially horizontally aligned fibers;

calendering the fleece and optionally needle punching from either one or both sides to form a non-woven web of fibers suitable for the buffing layer;

providing a source of crimped fibers suitable for the attachment layer, e.g., having a caliper of 17 dtex and an average fiber length of 75 mm and repeating the above steps to form a non-woven web of fibers suitable for use as the attachment layer;

overlaying the web to form the attachment layer with at least one web to form the buffing layer and needle punching the combined layers from the buffing layer to the attachment layer to form a laminate of the buffing and attachment layers;

optionally repeating the needle punching step one or more times to increase the structural integrity and density of the resulting material;

passing the resulting laminate through a bath of an aqueous-based latex, e.g., 20% by weight solids-of butadiene-acrylo nitrile copolymer in water, drying the laminate, and cutting to the desired size to form the buffing pad.

The web of fibers to form the attachment layer is preferably needle punched from one side only in order to attain a surface having a multiplicity of exposed loops of fiber which form an effective attachment surface for co-operation with the hook-face surface.

Objects and advantages of this invention are further illustrated by the following example, but the particular materials and amounts thereof recited in this example, as well as other conditions and details, should not be construed to unduly limit this invention.

EXAMPLE

A buffing pad having 60 mm long crimped 6.7 dtex viscose fibers (commercially available in crimped form from the VFG Company of Giengen/Brenz, Germany) on the buffing side and 60 mm long crimped 17 dtex viscose fibers (commercially available in crimped form from the VFG Company) on the attachment side was prepared. Using conventional equipment, each of the 6.7 dtex fibers and 17 dtex fibers were carded and air laid in a layer to provide fleeces of substantially horizontally aligned fibers. Each fleece was then calendered to provide a nonwoven web comprising 6.7 dtex fibers and a nonwoven web comprising 17 dtex fibers. The web comprising the 6.7 dtex fibers (buffing web) was overlaid onto the web comprising the 17 dtex fibers (attachment web). The webs were combined by needle punching from the buffing web through the attachment web using a needle having a needle size number of 32 (specifically the needle was 15×18×8.9 cm RB Gepraeght (=Embossed)). The needle punching provided about 500 apertures/cm. The resulting diameter of the resulting buffing pad was about 12.7 cm (5 inches).

A conventional automobile hood was sprayed with a 2K polyurethane two component paint (commercially available from Herberts of Wuppertal, Germany). The paint was cured by heating the painted hood in an oven at a temperature of about 60° C. for about 30 minutes.

To simulate a repair, a portion of the painted hood (about 2 cm by about 2 cm) was hand sanded using a 3.65 cm diameter scallop disc having 9 micrometer abrasive particles thereon (commercially available under the trademarked designation "FINESSE-IT 9 MICRON SCALLOP DISC" from the 3M Company of St. Paul, Minn.), which was mounted to a sanding hand block (commercially available under the trademarked designation "FINESSE-IT HAND BLOCK" from the 3M Company).

The buffing pad was attached to a conventional rotary air polishing machine with a soft, hook faced backup pad (commercially available under the trademarked designation "FINESSE-IT BACKUP PAD" from the 3M Company). The sanded area of the paint was buffed using the buffing pad and a buffing compound (commercially available under the trademarked designation "FINESSE-IT FINISHING COMPOUND" from the 3M Company). The free spinning rotational speed of the air polishing machine was about 1800 rpm. The buffing time was about 10 seconds.

The gloss of the buffed and unbuffed (i.e., a portion of the painted hood as sprayed and cured) were measured using a gloss meter (commercially available under the trade designation "NOVO-GLOSS NG 60C AUTO GLOSS METER" from Rhopoint Surface Instruments of Oxted Surrey, UK). The gloss of the buffed area measured at an angle of about 60 degrees was about 90 to 92, whereas the gloss of the unbuffed area was about 92.

The buffing pad was detached from the backup pad by pulling the pad perpendicularly from the pad-backup pad interface.

Various modifications and alterations of this invention will become apparent to those skilled in the art without departing from the scope and spirit of this invention, and it should be understood that this invention is not to be unduly limited to the illustrative embodiments set forth herein.

We claim:

1. A disc-shaped buffing pad laminate having one side adapted to be releasably engaged with a buffing apparatus having a hook-face attachment surface and an opposite side for buffing, said buffing pad laminate comprising a non-woven buffing layer comprising crimped fibers having a fiber thickness of up to 11 dtex and a fiber length of from 40 to 200 mm, a non-woven attachment layer comprising crimped fibers having a fiber thickness greater than 11 dtex and a fiber length of at least 40 mm, wherein said buffing layer and said attachment layer are secured together by intermingling fibers of said buffing layer with fibers of said attachment layer, said buffing pad having a diameter of from 50 to 200 mm, said buffing pad having a density of from 0.1 to 0.3 g/cm$^3$, and said buffing pad having a thickness of from 3 to 8 mm.

2. The buffing pad according to claim 1 wherein said crimped fibers of said buffing layer and said crimped fibers of said attachment layer are independently selected from the group of fibers consisting of cellulosic fibers, synthetic polymer fibers, and synthetic copolymer fibers.

3. A buffing pad as claimed in claim 1 in which said buffing layer comprises from 50 to 75% of the total pad thickness and said attachment layer comprises from 50 to 25% of the total pad thickness.

4. A buffing pad as claimed in claim 1 in which said fibers of said buffing layer have a length of from 40 to 80 mm.

5. A buffing pad as claimed in claim 1 in which said fibers of said attachment layer have a length of from 60 to 100 mm.

6. A buffing pad as claimed in claim 1 in which said fibers of said buffing layer have a length of from 40 to 80 mm and said fibers of said attachment layer have a length of from 60 to 100 mm.

7. A buffing pad as claimed in claim 1 in which said fibers of said buffing and attachment layers are independently selected from the group consisting of fibers of wool, cotton, viscose, polyamides, polyacrylates, polyesters, and nylons.

8. A disc-shaped buffing pad laminate having one side adapted to be releasably engaged with a buffing apparatus having a hook-face attachment surface and an opposite side for buffing, said buffing pad laminate consisting essentially of a non-woven buffing layer consisting essentially of crimped fibers having a fiber thickness of up to 11 dtex and a fiber length of from 40 to 200 mm, a non-woven attachment layer consisting essentially of crimped fibers having a fiber thickness greater than 11 dtex and a fiber length of at least 40 mm, wherein said buffing layer and said attachment layer are secured together by intermingling fibers of said buffing layer with fibers of said attachment layer, said buffing pad having a diameter of from 50 to 200 mm, said buffing pad having a density of from 0.1 to 0.3 g/cm$^3$, and said buffing pad having a thickness of from 3 to 8 mm.

9. The buffing pad according to claim 8 wherein said crimped fibers of said buffing layer and said crimped fibers of said attachment layer are independently selected from the group of fibers consisting of cellulosic fibers, synthetic polymer fibers, and synthetic copolymer fibers.

10. A buffing pad as claimed in claim 8 in which said fibers of said buffing layer have a length of from 40 to 80 mm.

11. A buffing pad as claimed in claim 8 in which said fibers of said attachment layer have a length of from 60 to 100 mm.

12. A buffing pad as claimed in claim 8 in which said fibers of said buffing layer have a length of from 40 to 80 mm and said fibers of said attachment layer have a length of from 60 to 100 mm.

13. A buffing pad as claimed in claim 8 in which said buffing layer comprises 50 to 75% of the total pad thickness and said attachment layer comprises 50 to 25% of the total pad thickness.

14. A buffing pad as claimed in claim 8 in which said fibers of said buffing and attachment layers are independently selected from the group consisting of fibers of wool, cotton, viscose, polyamides, polyacrylates, polyesters, and nylons.

* * * * *